US008056252B2

(12) United States Patent
Fernandes

(10) Patent No.: US 8,056,252 B2
(45) Date of Patent: Nov. 15, 2011

(54) MOISTURE REMOVAL SYSTEM

(76) Inventor: Joao Pascoa Fernandes, Winnipeg (CA)

( * ) Notice: Subject to any disclaimer, the term of this patent is extended or adjusted under 35 U.S.C. 154(b) by 818 days.

(21) Appl. No.: 12/136,406

(22) Filed: Jun. 10, 2008

(65) Prior Publication Data

US 2009/0025323 A1 Jan. 29, 2009

(30) Foreign Application Priority Data

Jun. 15, 2007 (CA) ..... 2594220

(51) Int. Cl.
*F26B 11/02* (2006.01)

(52) U.S. Cl. ..... 34/60; 34/210; 34/242; 454/184; 261/153; 261/112.1; 126/299 D; 126/629; 165/49; 165/53; 361/690; 361/695

(58) Field of Classification Search ..... 34/60, 70, 34/86, 90, 201, 210, 242, 105, 95; 126/299 D, 126/629; 165/49, 53; 62/314; 261/153, 261/112.1; 454/184; 361/690, 695
See application file for complete search history.

(56) References Cited

U.S. PATENT DOCUMENTS 2,294,780 A * 9/1942 Pfening ..... 34/83
2,318,027 A * 5/1943 Andrea et al. ..... 34/475
3,228,114 A * 1/1966 Smith, Jr. ..... 34/561
3,237,314 A * 3/1966 Smith, Jr. ..... 34/266
3,237,315 A * 3/1966 Benecke ..... 34/65
3,286,369 A * 11/1966 Smith, Jr. ..... 34/278
3,318,056 A 5/1967 Thompson
3,369,305 A * 2/1968 Becker ..... 34/451
3,456,357 A * 7/1969 Griffith ..... 34/401
3,520,066 A * 7/1970 Meade ..... 34/344
3,838,526 A * 10/1974 McAlpine ..... 34/418
3,850,224 A * 11/1974 Vidmar et al. ..... 164/456
3,899,836 A * 8/1975 Johnson ..... 34/225
3,931,684 A * 1/1976 Turnbull et al. ..... 34/242
3,932,946 A * 1/1976 Johnson ..... 34/201
4,114,334 A 9/1978 Thoren
4,132,013 A * 1/1979 Ferrarell ..... 34/653
4,154,861 A * 5/1979 Smith ..... 426/466
4,268,971 A * 5/1981 Noyes et al. ..... 34/395
4,305,210 A * 12/1981 Christensen et al. ..... 34/583
4,338,911 A * 7/1982 Smith ..... 126/21 A
4,404,756 A * 9/1983 Noyes ..... 34/65

(Continued)

FOREIGN PATENT DOCUMENTS

EP 2157228 A1 * 2/2010

(Continued)

*Primary Examiner* — Stephen M. Gravini
(74) *Attorney, Agent, or Firm* — Ryan W. Dupuis; Kyle R. Satterthwaite; Ade & Company Inc.

(57) ABSTRACT

A sheathing layer spans a supporting surface from which moisture is to be removed. In one exemplary system, ventilation channels extend between opposed ends of the substrate layer, communicating with an outlet opening at one end and with a duct at the opposing end which in turn communicates with an inlet opening at the same end of the substrate layer as the outlet opening. A fan is arranged to circulate air through channels from the inlet opening to the outlet opening to replace humid air in the channels with drier replacement air. In another example, a substrate layer includes ventilation channels communicating only between the supporting surface and an outlet opening. The outlet opening connects to a fan which maintains the channels at a vacuum pressure to withdraw moisture therefrom.

20 Claims, 2 Drawing Sheets

U.S. PATENT DOCUMENTS

| | | | | | |
|---|---|---|---|---|---|
| 4,409,453 | A | * | 10/1983 | Smith | 219/684 |
| 4,843,786 | A | | 7/1989 | Walkinshaw et al. | |
| 5,090,898 | A | * | 2/1992 | Smith | 431/326 |
| 5,092,520 | A | | 3/1992 | Lestage | |
| 5,155,924 | A | | 10/1992 | Smith | |
| 5,259,124 | A | * | 11/1993 | Poterala | 34/638 |
| 5,408,759 | A | | 4/1995 | Bass | |
| 5,555,643 | A | | 9/1996 | Guasch | |
| 5,621,983 | A | * | 4/1997 | Lundemann et al. | 34/641 |
| 5,659,972 | A | * | 8/1997 | Min et al. | 34/255 |
| 5,713,138 | A | * | 2/1998 | Rudd | 34/274 |
| 5,813,134 | A | * | 9/1998 | Min et al. | 34/255 |
| 5,881,476 | A | * | 3/1999 | Strobush et al. | 34/451 |
| 5,893,216 | A | | 4/1999 | Smith et al. | |
| 5,901,462 | A | * | 5/1999 | Rudd | 34/274 |
| 5,953,833 | A | * | 9/1999 | Rudd | 34/528 |
| 5,981,022 | A | * | 11/1999 | Min et al. | 428/98 |
| 6,202,321 | B1 | * | 3/2001 | Soucy | 34/507 |
| 6,256,903 | B1 | * | 7/2001 | Rudd | 34/412 |
| 6,418,834 | B1 | * | 7/2002 | Perrine | 99/334 |
| 6,438,862 | B1 | * | 8/2002 | Soucy | 34/168 |
| 6,530,160 | B1 | * | 3/2003 | Gookins | 34/418 |
| 6,688,018 | B2 | * | 2/2004 | Soucy | 34/68 |
| 6,691,427 | B1 | | 2/2004 | Fernandes et al. | |
| 6,713,107 | B2 | * | 3/2004 | Shefet et al. | 426/315 |
| 7,055,262 | B2 | * | 6/2006 | Goldberg et al. | 34/86 |
| 7,191,546 | B2 | * | 3/2007 | Maruca | 34/201 |
| 7,243,442 | B2 | * | 7/2007 | Myerholtz et al. | 34/103 |
| 7,377,052 | B2 | * | 5/2008 | Maruca | 34/201 |
| 7,665,225 | B2 | * | 2/2010 | Goldberg et al. | 34/73 |
| 2002/0004994 | A1 | * | 1/2002 | Rudd | 34/343 |
| 2003/0079363 | A1 | * | 5/2003 | Soucy | 34/60 |
| 2004/0025366 | A1 | * | 2/2004 | Soucy | 34/230 |
| 2005/0066538 | A1 | * | 3/2005 | Goldberg et al. | 34/218 |
| 2005/0278972 | A1 | * | 12/2005 | Maruca | 34/201 |
| 2006/0179676 | A1 | * | 8/2006 | Goldberg et al. | 34/77 |
| 2006/0254072 | A1 | * | 11/2006 | Myerholtz et al. | 34/93 |
| 2006/0288606 | A1 | * | 12/2006 | Thifault | 34/455 |
| 2007/0144032 | A1 | * | 6/2007 | Maruca | 34/469 |
| 2007/0204478 | A1 | * | 9/2007 | Myerholtz et al. | 34/282 |
| 2008/0178488 | A1 | * | 7/2008 | Shivvers | 34/169 |
| 2008/0201980 | A1 | * | 8/2008 | Bullinger et al. | 34/493 |
| 2008/0209758 | A9 | * | 9/2008 | Thifault | 34/455 |
| 2009/0025323 | A1 | * | 1/2009 | Fernandes | 52/302.1 |
| 2010/0050462 | A1 | * | 3/2010 | Attonito | 34/201 |

FOREIGN PATENT DOCUMENTS

| | | | | |
|---|---|---|---|---|
| EP | 2196438 | A1 | * | 6/2010 |
| GB | 2183206 | A | * | 6/1987 |
| JP | 57112244 | A | * | 7/1982 |
| JP | 01088044 | A | * | 4/1989 |
| JP | 01318998 | A | * | 12/1989 |
| JP | 04015003 | A | * | 1/1992 |
| JP | 07286776 | A | * | 10/1995 |
| JP | 09079557 | A | * | 3/1997 |
| JP | 09094393 | A | * | 4/1997 |
| JP | 09104327 | A | * | 4/1997 |
| JP | 11040536 | A | * | 2/1999 |
| JP | 2001293280 | A | * | 10/2001 |
| JP | 2002085890 | A | * | 3/2002 |
| JP | 2003062387 | A | * | 3/2003 |
| JP | 2003062390 | A | * | 3/2003 |
| JP | 2006340643 | A | * | 12/2006 |
| JP | 2008229467 | A | * | 10/2008 |
| JP | 2008232516 | A | * | 10/2008 |
| JP | 2010259980 | A | * | 11/2010 |
| JP | 2010259994 | A | * | 11/2010 |
| WO | WO 2004010065 | A1 | * | 1/2004 |
| WO | WO 2005061134 | A1 | * | 7/2005 |

* cited by examiner

MOISTURE REMOVAL SYSTEM

This application claims foreign priority benefits from Canadian Patent Application 2,594,220, filed Jun. 15, 2007.

FIELD OF THE INVENTION

The present invention relates to moisture removal systems arranged for removing moist air from a supporting surface, and more particularly comprises a moisture removal system for a supporting surface of the type for receiving finishing material thereon in which the system comprises a substrate layer for removing moist air between the supporting surface and the finishing material.

BACKGROUND

It is known to be desirable to remove excess moisture in buildings to prevent the accumulation of mold and for the comfort of occupants of the building. Moisture is particularly a problem in foundation areas of concrete structures in which the moisture can penetrate through concrete walls and floors into occupied spaces of the building.

The following US patents disclose several examples of systems related to moisture removal in a building: U.S. Pat. No. 5,893,216 belonging to Smith et al.; U.S. Pat. No. 5,555,643 belonging to Guasch; U.S. Pat. No. 5,408,759 belonging to Bass; U.S. Pat. No. 5,155,924 belonging to Smith; U.S. Pat. No. 5,092,520 belonging to Lestage; U.S. Pat. No. 4,843,786 belonging to Walkinshaw et al.; U.S. Pat. No. 4,114,334 belonging to Thoren; and U.S. Pat. No. 3,318,056 belonging to Thompson.

In each instance in the prior art, the systems are not well suited for installation as a substrate ready to accept finishing materials thereon and in a manner in which airflow for collecting moisture is optimized through a substrate area. In other instances the systems disclosed in the prior art are complex to install and/or costly.

U.S. Pat. No. 6,691,427 belonging to Fernandes et al. discloses a concrete wall heating and drying system in which panels of insulating material direct airflow across the surfaces of a concrete wall to be dried. The system works well, however in some instances the airflow pattern may be limited to particular wall configurations and the many redirections of air through manifold or plenum sections of the system do not always ensure even pressure and flow distribution for optimum moisture collection.

SUMMARY OF THE INVENTION

According to one aspect of the invention there is provided a moisture removal system for removing moisture from a supporting surface, the system comprising:

a sheathing layer arranged to span the supporting surface, the sheathing layer comprising:

first and second sides edges extending in a longitudinal direction between opposed inlet and outlet ends of the sheathing layer;

a rear side arranged for abutment with the supporting surface;

an inlet plenum at the inlet end of the sheathing layer;

an outlet plenum at the outlet end of the sheathing layer;

a plurality of channels extending in the longitudinal direction in communication between the inlet plenum and the outlet plenum;

the channels being arranged to communicate with the supporting surface through the rear side of the sheathing layer;

an inlet passage communicating between one of the ends of the sheathing layer and an inlet opening of the sheathing layer;

an outlet passage communicating between said one of the ends of the sheathing layer and an outlet opening of the sheathing layer such that the outlet opening and the inlet opening are located at the same one of the ends of the sheathing layer;

a fan arranged to circulate air through the channels from the inlet opening to the outlet opening of the sheathing layer; and a controller arranged to operate the fan so as to be arranged for replacing humid air in the channels with replacement air which is drier than the humid air.

By locating the inlet opening and the outlet opening together at one end of the substrate layer, air handling equipment can be efficiently setup in communication with the substrate layer. Furthermore the resulting passage which extends alongside the channels is more continuous with the inlet plenum so as to result in a more even pressure and flow distribution for optimum moisture collection when air is circulated through the channels.

According to another aspect there is provided a moisture removal system for removing moisture from a supporting surface, the system comprising:

a sheathing layer arranged to span the supporting surface, the sheathing layer comprising:

first and second sides edges extending in a longitudinal direction between opposed inlet and outlet ends of the sheathing layer;

a rear side arranged for abutment with the supporting surface;

a plurality of channels extending in the longitudinal direction between the inlet end and the outlet end;

the channels being arranged to communicate with the supporting surface through the rear side of the sheathing layer;

an outlet plenum in communication with all of the channels at the outlet end of the sheathing layer; and a fan arranged to withdraw air from an outlet opening in the outlet plenum;

a controller arranged to operate the fan to maintain the channels at a vacuum pressure.

When providing only suction on the channels to maintain the supporting surface at a vacuum pressure, a simple and low cost construction results which can be readily installed as a substrate layer between finishing materials and existing walls.

Preferably one of the passages comprises a duct extending generally in the longitudinal direction between the respective plenum at one end of the sheathing layer and the respective opening at the other end of the sheathing layer.

The inlet opening and the outlet opening may be located at opposing ones of the first and second side edges.

In the exemplary embodiment, the inlet opening and the outlet opening are both located at the outlet end of the substrate layer.

An inlet of the fan may be arranged to communicate with the outlet opening while the outlet of the fan is arranged to communicate with the inlet opening such that the fan communicates with both the inlet opening and outlet opening in a closed loop configuration. The fan is preferably connected in series with a dehumidifier and a heater.

Each channel and each plenum preferably comprises a groove defined between a pair of ridges which are in abutment with the supporting surface.

When the supporting surface comprises either an upright wall or a floor, the channels preferably extend horizontally across the supporting surface.

The system is particularly suited for a supporting surface comprising concrete.

When there is provided a finishing material for covering the supporting surface, the sheathing layer is preferably supported between the supporting surface and the finishing material.

The substrate layer is preferably formed of a plurality of panels of polystyrene material.

When the supporting surface comprises a foundation wall supporting a plurality of parallel and spaced apart floor joists thereon and the substrate layer is arranged for spanning an inner surface of the foundation wall and comprises insulating material, preferably there are also provided a plurality of first auxiliary supporting members in abutment with the substrate layer at one end of the member and each arranged for extending over the foundation wall between an adjacent pair of joists, and a plurality of second auxiliary panel members in abutment with the first auxiliary panel members respectively to extend upwardly therefrom while spanning between the respective adjacent pair of joists.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
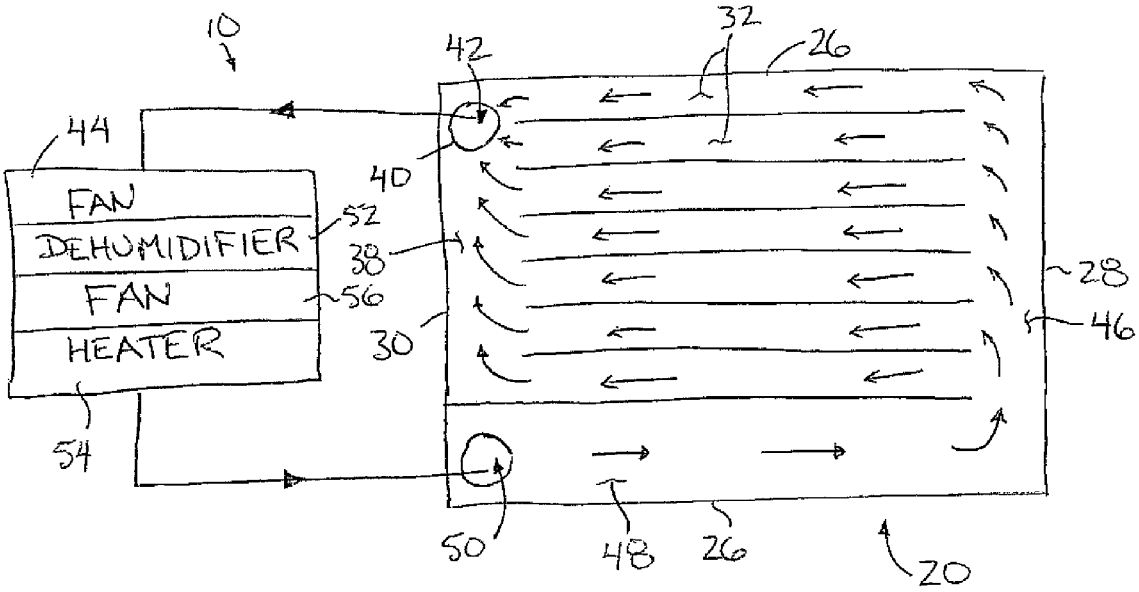
FIG. 1 is a schematic illustration of one of the moisture removal systems described herein.

Referring to the accompanying figures there are illustrated moisture removal systems generally indicated by reference numeral 10. The systems 10 are particularly suited for removing moisture from a supporting surface 12, for example a floor or a wall. Although variations to the systems 10 are described and illustrated herein, the common features will first be described.

The moisture removal system 10 is particularly suited for mounting as a substrate layer against a concrete wall or floor, for example a foundation wall in a building basement. When used as a substrate layer lining the inside of a concrete foundation wall, a plurality of floor joists are typically supported parallel and spaced apart from one another on top of the wall to span generally horizontally between two spaced apart walls. The joists 14 are typically joined by a header 16 resting on the top side of the wall.

The substrate layer of the system is formed of a plurality of panels of polystyrene or other suitable self supporting insulating material which permits finishing material 18 to be supported thereon so that the substrate layer 20 is received between the finishing material 18 and the concrete supporting surface 12.

In addition to panels forming the substrate layer 20 lining the surface of the walls and floor or a foundation, first auxiliary panels 22 and second auxiliary panels 24 of insulating material can be mounted between the joists for additional insulation. The auxiliary panels comprise pre-cut rigid panels in which the first auxiliary panels have a width which is snugly received between two adjacent joists and a length which is suitable for spanning from the top side of the substrate layer across the top side of the foundation wall for abutment with the header 16 at the outer side of the wall. The second auxiliary panels 24 have a width which is snugly received between two adjacent joists and a height corresponding approximately to the height of the header for spanning from the top of the foundation wall to the underside of flooring material supported on the joists. The auxiliary panels thus form a continuous layer with the panels of the substrate layer to fully insulate the enclosed space defined by the foundation wall.

The assembled panels which form the substrate layer are typically arranged in a rectangular pattern to define two side edges 26 which are parallel and opposite one another which extend in the longitudinal direction of the substrate layer 14 between an inlet end 28 and an outlet end 30 of the substrate layer which are generally parallel to one another and opposite one another as well.

The substrate layer also includes a plurality of channels 32 which span in the longitudinal direction between the opposed inlet and outlet ends. The channels are formed in the rear side of the substrate layer with each comprising a groove 34 extending in the longitudinal direction and defined between an adjacent pair of longitudinally extending ridges 36 between the grooves. The ridges are formed flush with the rear side of the substrate layer for abutment against the supporting surface across which the substrate layer spans. The supporting surface thus encloses the channels 32 so that the channels do not communicate with one another except for at opposed open ends thereof. The channels 32 thus primarily communicate with the supporting surface enclosing one side of the channels along the length thereof.

An outlet plenum 38 is formed at the outlet end 30 of the substrate layer in which the outlet plenum spans the open end of all of the channels at the outlet end of the substrate layer in communication therewith. An outlet passage 40 is defined in communication between the outlet plenum and an outlet opening 42 at the front side of the substrate layer at the outlet end of the substrate layer. The outlet opening 42 communicates by ducting to the inlet of a remotely located fan 44.

The outlet plenum 38 similarly comprises a groove formed in the rear side of the substrate layer which is enclosed against the supporting surface against which the substrate layer spans.

Figure 2:
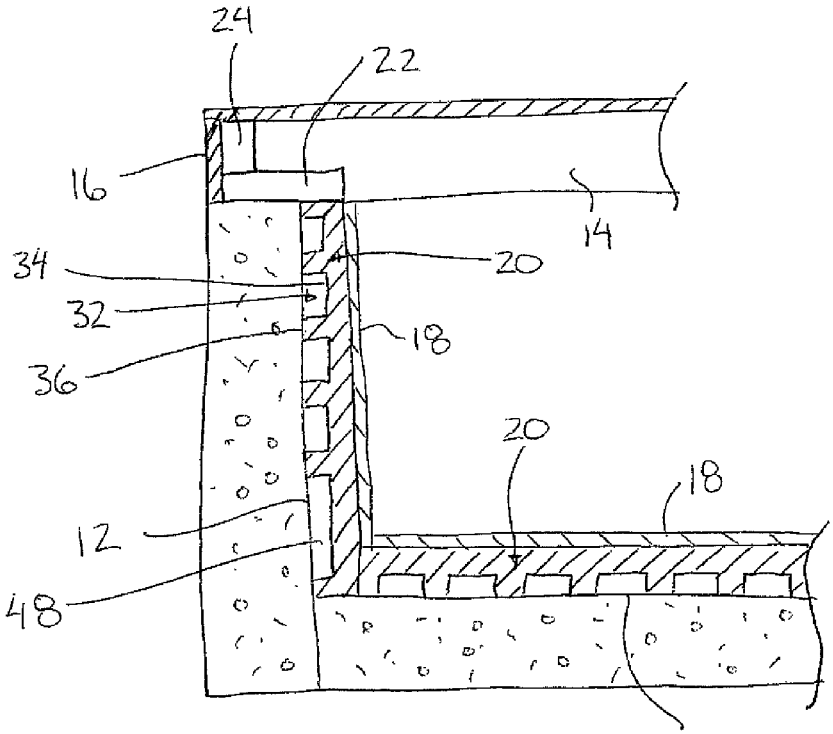
FIG. 2 is a sectional view generally along the line 2-2 of FIG. 1.
Figure 3:
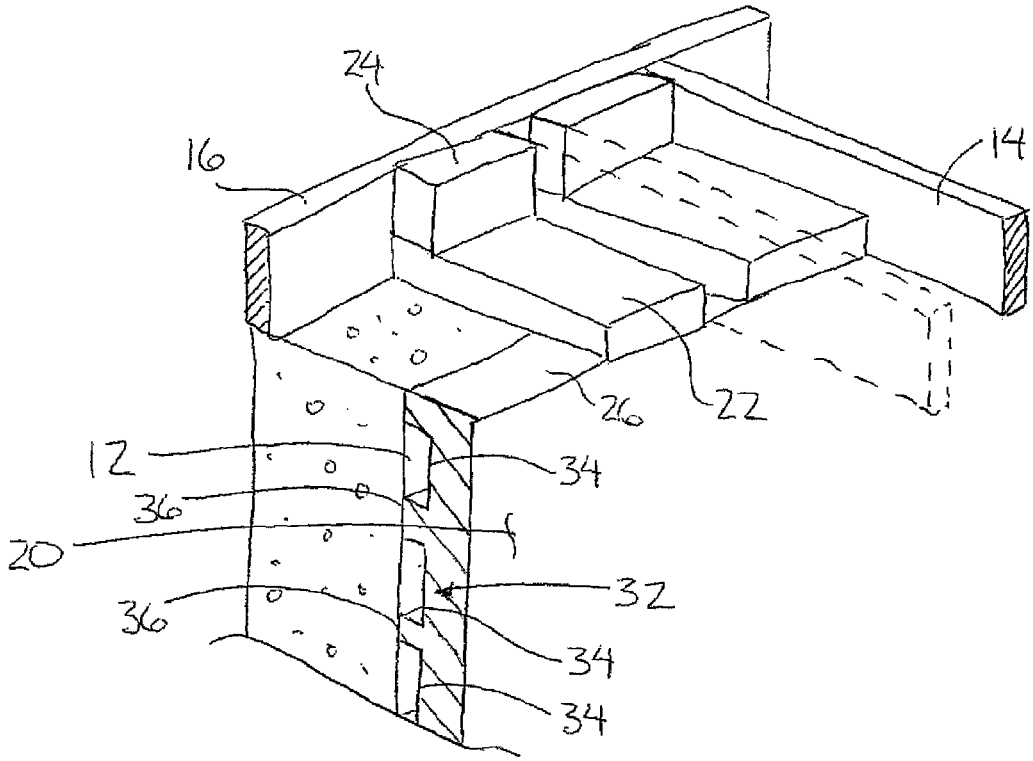
FIG. 3 is a perspective view of the system according to FIGS. 1 and 2 when installed on a foundation wall supporting floor joists thereon.

Turning now to FIGS. 1 through 3, according to the first moisture removal system 10 illustrated herein, there is also provided an inlet plenum 46 which spans in communication with the open end of all of the channels at the inlet end 28 of the substrate layer. An inlet passage 48 is located in the form of a duct extending generally parallel to the channels along one side edge of the substrate layer to communicate between the inlet plenum 46 and an inlet opening 50 located at the outlet end of the panel. The inlet opening and the outlet opening are located at opposing side edges of the substrate layer but at the common outlet end of the substrate layer. When supported on a wall, the channels are oriented to extend horizontally with the inlet passage 48 being formed along the bottom edge of the substrate layer. The inlet opening is accordingly located at one end of the substrate layer at the bottom side thereof while the outlet opening is located directly above the inlet opening at the top end of the substrate layer but at the same end of the layer as the inlet opening.

As noted above, air is drawn out of the channels through the outlet plenum and outlet opening by ducting in communication with the inlet of the fan 44. The fan then directs the air from its outlet to a dehumidifier 52 to remove moisture from the air. The air is then directed to a heater 54 with a booster fan 56 being provided to increase airflow where desired between the dehumidifier and the heater. The airflow is continued to be directed by ducting in a closed loop configuration which then feeds back to the inlet opening 50. A suitable controller operates the fans, the dehumidifier and the heater responsive to moisture conditions to replace humid air in the channels with replacement air which is drier than the humid air.

From the inlet opening the airflow is directed horizontally along the bottom side of the substrate layer and is smoothly directed upward at the opposing inlet end to transition smoothly into the inlet plenum as the air is redirected upwardly into the open inlet ends of all of the channels. The inlet opening and inlet passage are also formed as grooves in the rear side of the panels forming the substrate layer which are enclosed by the substrate surface across which the substrate layer spans.

In use, operation of the fans causes the moist air in the channels to be replaced by first removing the air, then drying the air in the dehumidifier and then heating the air prior to returning to the channels so that the heated air can collect yet further moisture before returning to the dehumidifier yet again. In other embodiments, the fan may comprise only an exhaust fan which draws the moist air out through the outlet opening so that the inlet opening is in communication with the ambient surroundings drawing in drier ambient air to replace the exhausted air. In yet a further arrangement, the fan may be arranged to draw drier ambient air from the surroundings and force the dry air into the inlet opening of the substrate layer to expel the moist air in the channels of the substrate layer. A suitable controller is provided to operate the fan continuously in some instances, or only responsive to a prescribed moisture level being reached if desired.

Figure 4:
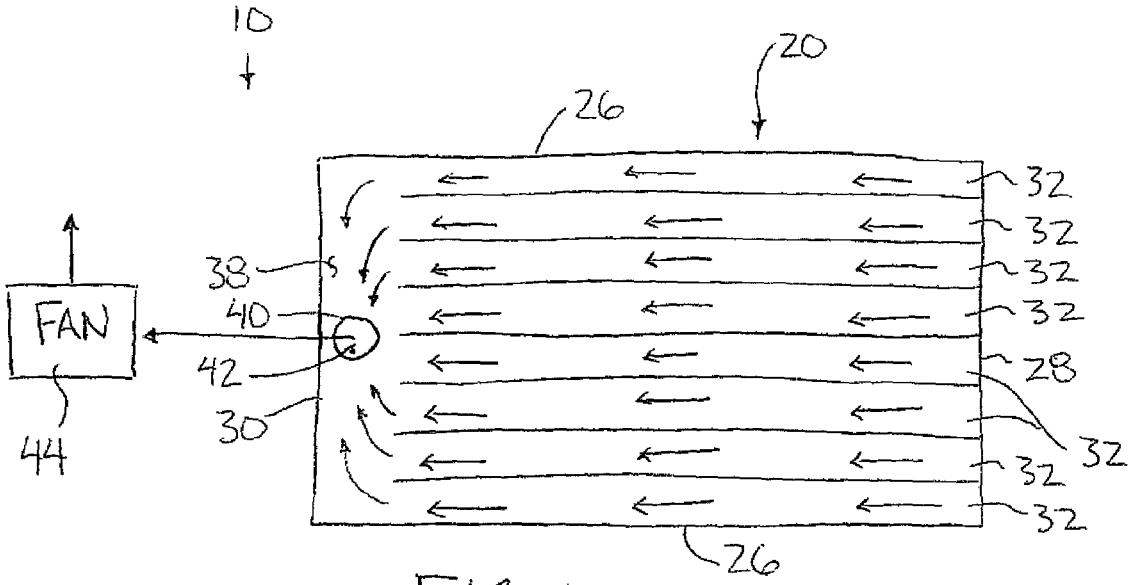
FIG. 4 is a schematic illustration of an alternative moisture removal system.

Turning now to the moisture removal system of FIG. 4, the channels are shown enclosed at the inlet ends thereof so that air can only be drawn into the channels by drawing any moisture or air through the porous supporting surface across which the substrate layer spans. The outlet opening communicates with the inlet of the fan. Operation of the fan by a suitable controller is arranged to maintain a prescribed vacuum pressure in the channels relative to the ambient or atmospheric pressure. As moisture is drawn through the material forming the floor or walls defining the supporting surface 12, and reaches the inner side of the supporting surface, the moisture comes into contact with the vacuum pressure environment of the channels to cause the moisture to be readily evaporated and withdrawn by the fan to be exhausted externally of the building.

In further embodiments the sheathing layer described above with regard to FIG. 1 through 3 can be used in a manner similar to the system of FIG. 4 by providing a suitable capping member across the inlet opening of the substrate layer. Operation of the fan can then be arranged by the controller to simply withdraw air or moisture from the channels through the outlet opening for being exhausted externally of the building.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A moisture removal system for removing moisture from a supporting surface, the system comprising:

a sheathing layer arranged to span the supporting surface, the sheathing layer comprising:

first and second sides edges extending in a longitudinal direction between opposed inlet and outlet ends of the sheathing layer;

a rear side arranged for abutment with the supporting surface;

an inlet plenum at the inlet end of the sheathing layer;

an outlet plenum at the outlet end of the sheathing layer;

a plurality of channels extending in the longitudinal direction in communication between the inlet plenum and the outlet plenum;

the channels being arranged to communicate with the supporting surface through the rear side of the sheathing layer;

an inlet passage communicating between one of the ends of the sheathing layer and an inlet opening of the sheathing layer;

an outlet passage communicating between said one of the ends of the sheathing layer and an outlet opening of the sheathing layer such that the outlet opening and the inlet opening are located at the same one of the ends of the sheathing layer;

a fan arranged to circulate air through the channels from the inlet opening to the outlet opening of the sheathing layer; and a controller arranged to operate the fan so as to be arranged for replacing humid air in the channels with replacement air which is drier than the humid air.

2. The system according to claim 1 wherein one of the passages comprises a duct extending generally in the longitudinal direction between the respective plenum at one end of the sheathing layer and the respective opening at the other end of the sheathing layer.

3. The system according to claim 1 wherein the inlet opening and the outlet opening are located at opposing ones of the first and second side edges.

4. The system according to claim 1 wherein the inlet opening and the outlet opening are both located at the outlet end of the substrate layer.

5. The system according to claim 1 wherein an inlet of the fan is arranged to communicate with the outlet opening.

6. The system according to claim 1 wherein an outlet of the fan is arranged to communicate with the inlet opening.

7. The system according to claim 1 wherein the fan communicates with both the inlet opening and outlet opening in a closed loop configuration and wherein the fan is connected in series with a dehumidifier.

8. The system according to claim 1 in combination with the supporting surface wherein each channel comprises a groove defined between a pair of ridges which are in abutment with the supporting surface.

9. The system according to claim 1 in combination with the supporting surface wherein the plenums each comprise a groove defined between surrounding ridges which are in abutment with the supporting surface.

10. The system according to claim 1 in combination with a supporting surface comprising an upright wall wherein the channels extend horizontally across the wall.

11. The system according to claim 1 in combination with a supporting surface comprising a floor wherein the channels span horizontally across the floor.

12. The system according to claim 1 in combination with a supporting surface comprising concrete.

13. The system according to claim 1 in combination with a finishing material for covering the supporting surface, the sheathing layer being supported between the supporting surface and the finishing material.

14. The system according to claim 1 wherein the substrate layer is formed of a plurality of panels of polystyrene material.

15. The system according to claim 1 for a supporting surface comprising a foundation wall supporting a plurality of parallel and spaced apart floor joists thereon wherein the substrate layer is arranged for spanning an inner surface of the foundation wall and comprises insulating material and wherein there is provided a plurality of first auxiliary supporting members in abutment with the substrate layer at one end thereof and each arranged for extending over the foundation wall between an adjacent pair of joists, and a plurality of second auxiliary panel members in abutment with the first auxiliary panel members respectively to extend upwardly therefrom while spanning between the respective adjacent pair of joists.

16. A moisture removal system for removing moisture from a supporting surface, the system comprising:

a sheathing layer arranged to span the supporting surface, the sheathing layer comprising:

first and second sides edges extending in a longitudinal direction between opposed inlet and outlet ends of the sheathing layer;

a rear side arranged for abutment with the supporting surface;

a plurality of channels extending in the longitudinal direction between the inlet end and the outlet end;

the channels being arranged to communicate with the supporting surface through the rear side of the sheathing layer;

an outlet plenum in communication with all of the channels at the outlet end of the sheathing layer; and a fan arranged to withdraw air from an outlet opening in the outlet plenum;

a controller arranged to operate the fan to maintain the channels at a vacuum pressure.

17. The system according to claim 16 in combination with the supporting surface wherein each channel comprises a groove defined between a pair of ridges in abutment with the supporting surface.

18. The system according to claim 16 in combination with the supporting surface wherein the plenums each comprise grooves defined between surrounding ridges in abutment with the supporting surface.

19. The system according to claim 16 in combination with a supporting surface comprising an upright wall wherein the channels extend horizontally across the wall.

20. The system according to claim 16 in combination with a supporting surface comprising concrete.

* * * * *